US006347750B1

(12) United States Patent
Delettre

(10) Patent No.: US 6,347,750 B1
(45) Date of Patent: Feb. 19, 2002

(54) WATER DISPLAY GENERATING TWO-DIMENSIONAL FLOW PATTERNS, OVERFLOW CHANNEL USED THEREIN AND WORKING METHOD

(76) Inventor: Jean-Pierre Delettre, 3, Rue Pasteur, 89110-Chassy (FR)

( * ) Notice: Subject to any disclaimer, the term of this patent is extended or adjusted under 35 U.S.C. 154(b) by 0 days.

(21) Appl. No.: 09/522,009

(22) Filed: Mar. 9, 2000

(51) Int. Cl.[7] ..... B05B 17/08

(52) U.S. Cl. ..... 239/17; 239/21; 239/193; 239/548; 239/590.3

(58) Field of Search ..... 239/17, 16, 18, 239/20, 21, 22, 23, 193, 211, 548, 567, 568, 553.3, 590.3; 210/167, 169, 416.1, 416.2, 495, 499

(56) References Cited

U.S. PATENT DOCUMENTS

| | | | | |
|---|---|---|---|---|
| 1,689,790 A | * | 10/1928 | Lefevre, Jr. | 239/17 |
| 3,764,525 A | * | 10/1973 | Goodman et al. | 210/499 X |
| 4,149,674 A | * | 4/1979 | Fukamizu et al. | 239/20 |
| 5,167,368 A | | 12/1992 | Nash | 239/17 |
| 5,226,935 A | * | 7/1993 | Wolff et al. | 239/193 X |
| 5,571,409 A | * | 11/1996 | Scarborough | 239/20 X |

FOREIGN PATENT DOCUMENTS

| | | |
|---|---|---|
| FR | 2 625 116 | 6/1989 |
| GB | 2185541 | 7/1987 |
| GB | 2256157 | * 12/1992 |
| WO | 99/13991 | 3/1999 |

* cited by examiner

*Primary Examiner*—Steven J. Ganey
(74) *Attorney, Agent, or Firm*—James C. Lydon

(57) ABSTRACT

A water display installation generating two-dimensional flow patterns on a net wall which includes a reservoir supplied with liquid by a conduit incorporating a plurality of perforations emerging into the reservoir, and provided with an overflow lip arranged such that the liquid flows from the reservoir along the wall. The reservoir includes a filtering foam for ensuring uniformity of the liquid flow from one end of the lip to the other end.

10 Claims, 3 Drawing Sheets

WATER DISPLAY GENERATING TWO-DIMENSIONAL FLOW PATTERNS, OVERFLOW CHANNEL USED THEREIN AND WORKING METHOD

TECHNICAL FIELD

This invention relates to a water display installation generating two-dimensional flow patterns, the overflow channel used therein and the working method for said installation.

BACKGROUND ART

The creation of water screens is not new and numerous procedures are already in use. However the apparatus and materials currently implemented present major drawbacks due to:

complexity of operation, restrictive dimensions, low mechanical ruggedness, bad endurance over time and vulnerability to bad weather.

Accordingly, until now the proposed systems fail to meet a certain number of requirements.

In contrast, the present invention presents a high degree of flexibility in terms of size and shape, and offers a great mobility at low construction and maintenance costs.

The adaptability of the process is based on a combination of several significant innovations:

air permeability and visual transparency thanks to the size of the net mesh, large span construction scalable in terms of both height and width lightness and tolerance thanks to multiple adjustment points, low volume reservoirs thanks to a maximum water spread

SUMMARY OF THE INVENTION

The object of the invention is to create a water display installation enabling to form a thin film of water flowing over both faces of a translucent wall, thus generating two-dimensional flow patterns.

This object is attained by means of an installation comprising an overflow device which integrates:

a reservoir provided with an overflow lip extending along the full length of one of its sides; said reservoir being designed to be filled with a liquid.

a water conduit oriented according to direction approximately parallel with the lip, incorporating multiple perforations giving into the reservoir, and characterized by a filtering foam contained in said reservoir and positioned between the conduit and the overflow lip, a beam located outside the reservoir on the side opposite the lip.

adjustable brackets designed to support the reservoir against the beam, these brackets being fixed to the beam by means of a rear back plate and are fitted with adjusting means to enable them, and thus the reservoir, to be moved vertically wit respect to the beam.

A wall in the form of a net, one end of which is fixed to the reservoir, fits the profile of the lip and extends beyond said reservoir.

The invention also includes a collector comprising:

An opening designed to let the net wall pass,

A suction pump,

A filtering system interposed between the opening and the pump. This system should preferably be composed of a mesh filter extending over the entire length of said collector.

The collector according to the invention, may be simply placed on the ground or introduced into a trench dug in the soil.

The net wall used in the invention is preferably made of nylon thread (polyamid-6,6), such as a fishing net or like. The size and shape of the mesh, as well as the composition of the thread of which the net is made will vary according to the desired flow patterns and will depend on the height of the installation. A diamond shaped mesh measuring from 3 to 5.5 mm could be used although this is not restrictive. In addition, a thread with a fiber count of approximately 100 thru 435 tex (10,000 to 2,300 linear meters per kilogram) may be used although this is not restrictive.

The net is advantageously fixed to the reservoir by a bar threaded through the net mesh, at the level of one end of the net. This bar abuts against two flat sections or battens hinged together so as to grip the net, one of these battens being fixed such as by welding to the reservoir. Alternatively, the net may be fixed to said reservoir by any other suitable fixation means. The net may be hung freely from the reservoir and may be given a draped, pleated or waved appearance. The net should however also be fixed at the other end in order to be held taut. For this, attachments may be advantageously provided for the opposed end of the net, associated with a means of tensioning the net. This could for example take the form of a weighted tube or rod along the entire length of the net, supported by the net in the vicinity of its opposed end.

The cross section and the length of the reservoir can be variable, depending on the desired configuration of the water display installation. The reservoir could thus be curved, rectilinear, or polygonal, with circular, rectangular, square or trapezoid transverse section.

The reservoir is fitted with at least one overflow side, enabling the liquid to spill over an overflow lip and down the net.

The submerged water conduit running along all the length of the reservoir with multiple perforations to distribute the liquid into the reservoir and a filtering foam along all the length of said reservoir ensure a uniform flow of liquid from one end of the lip to the other. This will prevent the formation of eddies and ensures an even flow of liquid down the full length of the wall. This parameter is particularly critical when a very thin curtain of liquid is desired on the net wall.

The use of a floating filtering foam with a saturated density close to that of the water after filling of its pores, ensures that the water surface is evened out before it brims over. The foam filter is a determining feature of the invention as it enables water flow to be minimized and, consequently, the volume and weight of the reservoir to be reduced. This in turn makes for easy adjustment of the support brackets even during operation.

In fact, to obtain a film of liquid as thin as 0.8 to 2.7 mm over a net about 6 m high, requires a flow of liquid as low as 5 to 16 liters per minute per linear meter of the net. Even slight variations in such a small flow can lead to variations in the thickness of the liquid film which will result in undesirable disturbances in the flow patterns created by the net.

The homogeneity of the flow is more improved by moving the reservoir up and down by means of the adjusting means which enables the horizontality of the lip to be adjusted micrometrically to compensate for movement, uneven ground or distortion of the materials.

The water display installation according to the invention can be used in a variety of applications, in particular as an exterior decorative feature and/or partition or in any other type of premises.

The invention relates also to an operating method used to obtain a continuous film of liquid presenting two-directional flow patterns over a wall, comprising the following steps a) the attachment of a net to a reservoir fitted with an overflow lip, b) the supply of said liquid into the reservoir at a chosen flow rate from a conduit, through a plurality of perforations located successively along a direction parallel to the lip, c) the passage of the liquid through a filtering foam positioned in said reservoir, d) the adjustment of the lip by leveling the reservoir relative to a beam positioned outside the reservoir on the side opposite the lip, so that the liquid brims over from the reservoir in a controlled flow down the net wall.

BRIEF DESCRIPTION OF THE DRAWINGS

The invention will be understood more easily from the following detailed description of a non-restrictive example of implementation, to be read in combination with the following attached drawings.

DETAILED DESCRIPTION OF THE INVENTION

Figure 1:
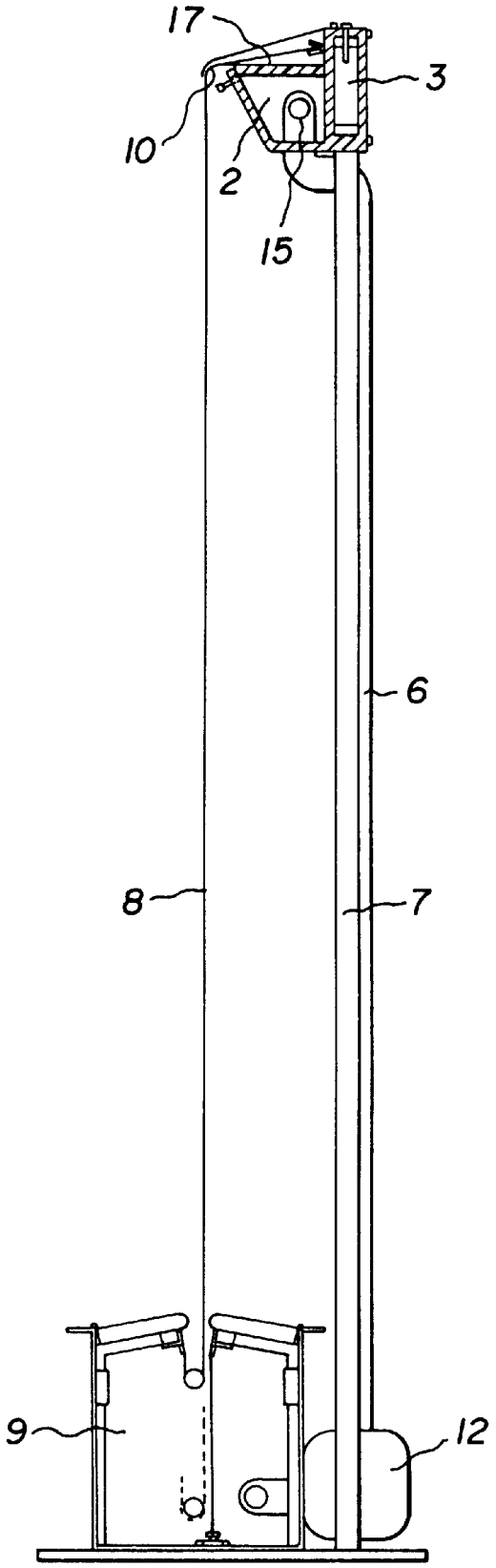
FIG. 1 is a general view of the cross section of the water display installation.

FIG. 1 shows a general view of the water display installation comprising an overflow device (1) supported on vertical columns (6) some 6 meters apart and supplied with water by a pipe (7) positioned close to the vertical columns (6), a collector (9) and a net (8).

The overflow device, which is described in greater detail with reference to FIG. 3, comprises a reservoir (2) and a horizontal beam (3) resting on the vertical columns (6). The reservoir (2) and the beam (3) may be up to several meters in length depending on the configuration of the installation. In the example shown, the reservoir (2) has a trapezoid transverse section which is prolonged by the lip (10), while the horizontal beam (3) has a hollow metal (e.g. aluminum or galvanized steel) box structure. The reservoir (2) and the beam (3) are held together by means of brackets (4) about 1.5 meters apart. The whole apparatus is covered by a housing (5).

The net (8) is fixed at one end to the reservoir (2) from where it passes over the overflow lip (10) and down into the collector (9). The net is held taut between the reservoir (2) and the collector (9) by means of a weighted rod (37).

Figure 2:
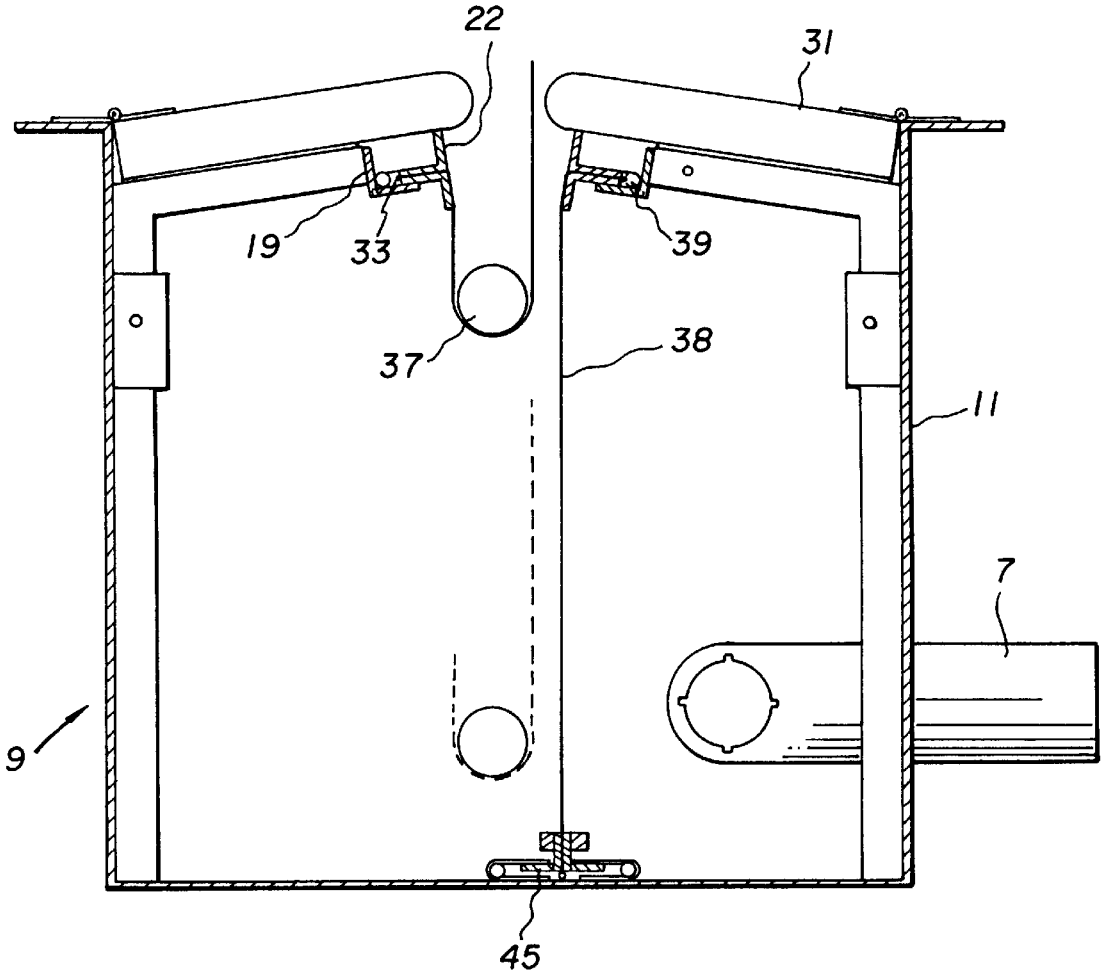
FIG. 2 is a detailed diagram of the cross section of the collector in FIG. 1.

The collector (9) which is described below with reference to FIG. 2 is assembled in a walled trench sunk into the ground, directly below the lip, with the aim of collecting the liquid flowing down from the overflow device (1) via the netting (8). After being filtered the liquid is returned back to the reservoir (2) by means of a suction pump (12) via the pipe (7).

Figure 3:
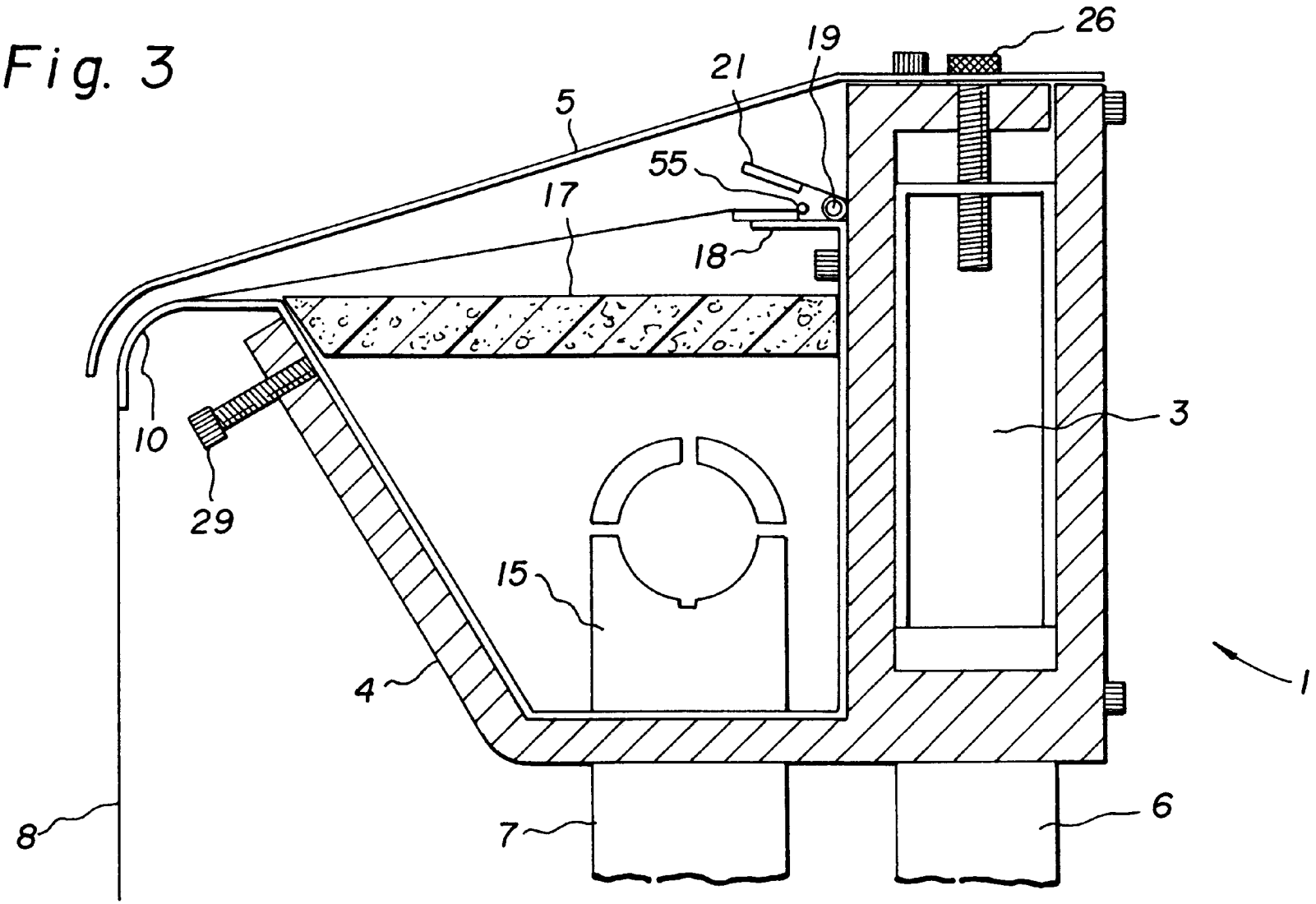
FIG. 3 is a detailed diagram of the cross section of the overflow device in FIG. 1

FIG. 3 shows that the pipe (7) leads into a perforated conduit (15), approximately 50 mm in external diameter, which is mounted at each end by means of a suitable support (not shown), on the bed of the reservoir in such a way that the ends of the conduit (15) are closed. The conduit (15) comprises multiple perforations.

A filtering foam immersed in the liquid and covering the entire exposed surface of the reservoir ensures that the surface of the liquid remains flat and even. The filtering foam (17) may be made of polyurethane-polyester.

As shown in FIG. 3, the side of the reservoir (2) opposite to the lip is fitted with a flange (18) which projects inside of the reservoir and on which are assembled the primary means of attaching the net. These means of attachment consist of flat sections or battens (21), which run the entire length of the installation. The flat sections (21) are joined together by hinges (19) and are designed to grip the end of the net (8) between them. The means of attaching the net also includes a metal bar (55) which is threaded through the mesh at the extremity of the net (8) and which is positioned to abut the flat sections (21).

The overflow lip can be adjusted horizontally even when the device is fully assembled by tightening or loosening the adjusting screws (26).

The large number of bearing points and bracket adjusters is important because these can be used to:

correct distortions in the manufactured materials utilized, permit higher machining tolerances use thinner materials (15/10 stainless steel for the overflow device) thus lightening the structure, correct the horizontality of the overflow device even during operation.

One arm of the bracket (4) which extends along the side of the reservoir (2) opposite the beam (3) as far as the lip (10) is traversed by a screw (29) which can be used as necessary to bear on the reservoir (2) to fine tune the horizontal position of the lip (10). This screw (29) allows for a slight play between the reservoir (2) and the bracket (4).

Coming back to FIG. 1, the liquid running down the net (8) via the overflow device illustrated in FIG. 3 is recovered in the collector (9) which is described below with reference to FIG. 2.

FIG. 2 shows that the collector (9) in this implementation of the installation comprises a tank (11) on which are assembled at (31), two pivoting rows of gratings (32) leaving a lengthwise space between them which is designed to receive the lower part of the net and the liquid flowing down the net. The bottom end (33) of the net (8) is immobilized by means of an attachment composed of angled sections similar to (22), joined together by means of two hinges (19) and designed to grip the bottom of the net (33) in a manner similar to the main means of attaching the net (8).

In addition to the means of attaching the net (8), FIG. 2 also shows a means of tensioning the net, composed of a weighted rod (37), made, for example, of galvanized steel, supported by the net (8) near its bottom end (33). This rod (37) could apply a load of some 15 Kg per linear meter to the net. This ballest rod is designed to avoid any slackness in the net and could be particularly useful in the management of the length of the net as shown by the broken lines in FIG. 2.

The collector (9) further contains a filter net (38) with a 1 mm mesh.

The filter net (38) is stretched between two anchor points (39) and (45) to which it is fixed respectively at each end as shown in FIG. 2.

As can be seen from the above description, the maintenance and dismantling of the collector will be particularly simple and rapid. The entire collector apparatus is easily accessible and can be removed entirely from the trench after pivoting or removing the gratings (31).

As shown in FIGS. 1 and 2 together, a conduit runs from the interior of the collector (9) to the pipe (7) via the suction pump (12).

It results from the above description that the invention provides a simple, low cost means of forming a thin continuous film of liquid creating two-dimensional flow patterns over the entire surface of non-rigid wall.

The invention is not, of course, limited to the particular form of implementation described above but also comprises all and any variations and equivalents entering within the scope of the attached claims.

What is claimed is:

1. Water display installation generating two-dimensional flow patterns on a flow wall, comprising a reservoir supplied with liquid by an inlet conduit incorporating multiple perforations and leading into said reservoir, and fitted with an overflow lip in such a manner that the liquid overflows from the reservoir down said wall; said installation being characterized in that said reservoir contains a filtering foam located between the inlet conduit and the lip and adapted to ensure a uniform flow of liquid from one end of the lip to the other end, wherein the flow wall is a net wall.

2. The installation according to claim 1, further comprising a collector incorporating an opening designed to receive the liquid flowing down the wall, a suction pump and a filtering system located between said opening and said pump.

3. The installation according to claim 2, in which the filtering system comprises a net filter which is positioned along the entire length of the collector, between said opening and said pump.

4. The installation according to claim 2, in which said collector contains means for attaching the bottom end of the net wall and means for tensioning the net.

5. The installation according to claim 4, wherein said means for tensioning the net comprises a weighted rod supported by the net in the vicinity of the bottom end.

6. The installation according to claim 1, wherein said inlet conduit is positioned within said reservoir and below said overflow lip so as to be submerged by a liquid during operation of said installation.

7. A water display installation generating two-dimensional flow patterns on a flow wall, comprising a reservoir supplied with liquid by an inlet conduit incorporating multiple perforations and leading into said reservoir, and fitted with an overflow lip in such a manner that the liquid overflows from the reservoir down said wall; said installation being characterized in that said reservoir contains a filtering foam adapted to ensure a uniform flow of liquid from one end of the lip to the other end, further comprising adjustable brackets, designed to support the reservoir against a beam, said brackets being designed to be maintained thereto.

8. The installation according to claim 7, in which the brackets comprise an adjusting screw designed to move the reservoir vertically with respect to the beam.

9. The installation according to claim 7, in which the brackets comprise a screw designed to bear on the reservoir thus enabling the horizontality of the lip to be adjusted.

10. A water display installation generating two-dimensional flow patterns on a flow wall, comprising a reservoir supplied with liquid by an inlet conduit incorporating multiple perforations and leading into said reservoir, and fitted with an overflow lip in such a manner that the liquid overflows from the reservoir down said wall; said installation being characterized in that said reservoir contains a filtering foam adapted to ensure a uniform flow of liquid from one end of the lip to the other end, wherein the flow wall is a net wall whose end is fixed to the reservoir by a bar threaded through the net, said bar abutting against two flat sections or battens hinged together in order to grip the net.

* * * * *